United States Patent [19]

Curtin et al.

[11] Patent Number: 4,582,972

[45] Date of Patent: Apr. 15, 1986

[54] CHAIN FEED MECHANISM FOR AN INDUCTION HEATING FURNACE

[75] Inventors: Oscar D. Curtin, Milford; Arthur A. Stephens, West Bloomfield, both of Mich.

[73] Assignee: General Motors Corporation, Detroit, Mich.

[21] Appl. No.: 643,169

[22] Filed: Aug. 22, 1984

[51] Int. Cl.[4] ..... H05B 6/16

[52] U.S. Cl. ..... 219/10.69; 219/10.71; 219/388; 198/817; 198/851; 373/142; 432/239; 414/171

[58] Field of Search ..... 219/10.69, 10.71, 10.57, 219/388; 198/817, 851, 957; 373/138, 142; 432/140, 239; 414/157–159, 171, 196

[56] References Cited

U.S. PATENT DOCUMENTS

| | | | |
|---|---|---|---|
| 2,583,338 | 1/1952 | Morse et al. | 219/10.69 X |
| 2,603,741 | 7/1952 | Seifried et al. | 219/10.69 X |
| 2,612,595 | 9/1952 | Warren | 219/10.69 |

*Primary Examiner*—Philip H. Leung

*Attorney, Agent, or Firm*—Donald F. Scherer

[57] ABSTRACT

A feed chain mechanism for continuously feeding metal bars through an induction furnace has a pair of laterally spaced feed chains. Each feed chain includes a plurality of links with alternate links being formed from stainless steel and ceramic material, respectively. The stainless steel links are disposed in pairs and form a drive slot. The stainless steel links on one of said feed chains is laterally opposite the ceramic links on the other feed chain to prevent the creation of a continuous loop for conducting electrical current in adjacent metal bars which are laterally spanning the chains. The feed chains are driven by cogwheels which mesh with the drive slot formed between the stainless steel links.

3 Claims, 3 Drawing Figures

CHAIN FEED MECHANISM FOR AN INDUCTION HEATING FURNACE

This invention relates to feed mechanisms and more particularly to feed chain mechanisms used with heat treatment equipment.

The steel bars from which leaf springs are formed are heat-treated in an induction type furnace. Upon leaving the furnace, the steel bars are then hotworked to form the basic shape of the leaf spring. The presently available feed mechanisms used to transport the steel bars through the induction furnace consist of a pair of rails and a pusher mechanism for pushing the bars, laterally spanning the rails, through the induction furnace. The adjacent bars are in contact with each other during their travel through the induction furnace. Since these bars are not perfectly flat along their abutting edges, gaps therebetween will occur which permit arcing between the bars resulting in localized overheating. Also, when the furnace is originally started, a number of bars originating in the induction heating zone are pushed out of the heating zone before being sufficiently heat-treated to permit the forming operation. These bars are either wasted or must be recycled which adds to the overall cost of manufacture of the spring.

The present invention maintains the bars separated on laterally spaced feed chains which are comprised of alternating stainless steel and ceramic links. The chains are aligned laterally such that both ends of adjacent bars do not contact common stainless steel link members thereby preventing the creation of a secondary loop such that no arcing between adjacent bars will occur. Also, since the bars do not have to be in continuous contact with each other, as with the pushing operation, the heat-treating process can be ceased after the final bar has passed through the furnace and the furnace operation can be commenced before the first bar on the chain will enter the furnace during respective shutdowns and start-ups of the induction furnace. It is, therefore, not likely that any of the bars will have to be reheated or scrapped due to improper heat-treating.

It is therefore an object of this invention to provide an improved feed chain mechanism for moving metal bars through an induction heat-treating structure while maintaining adjacent bars out of contact with each other and, through alternating ceramic and steel links on the chains, preventing the completion of a secondary induction loop which would result in arcing between adjacent bars.

It is another object of this invention to provide an improved feed chain mechanism for heating steel bars through an induction heat treatment apparatus wherein the feed chain mechanism has laterally spaced feed chains each comprised of stainless steel and ceramic materials alternately and pivotally connected and wherein the feed chains are laterally spaced and driven by cogwheels which maintain the steel links laterally opposite the ceramic links respectively on the laterally spaced feed chains.

These and other objects and advantages of the present invention will be more apparent from the following specification and drawings in which.

Figure 1:
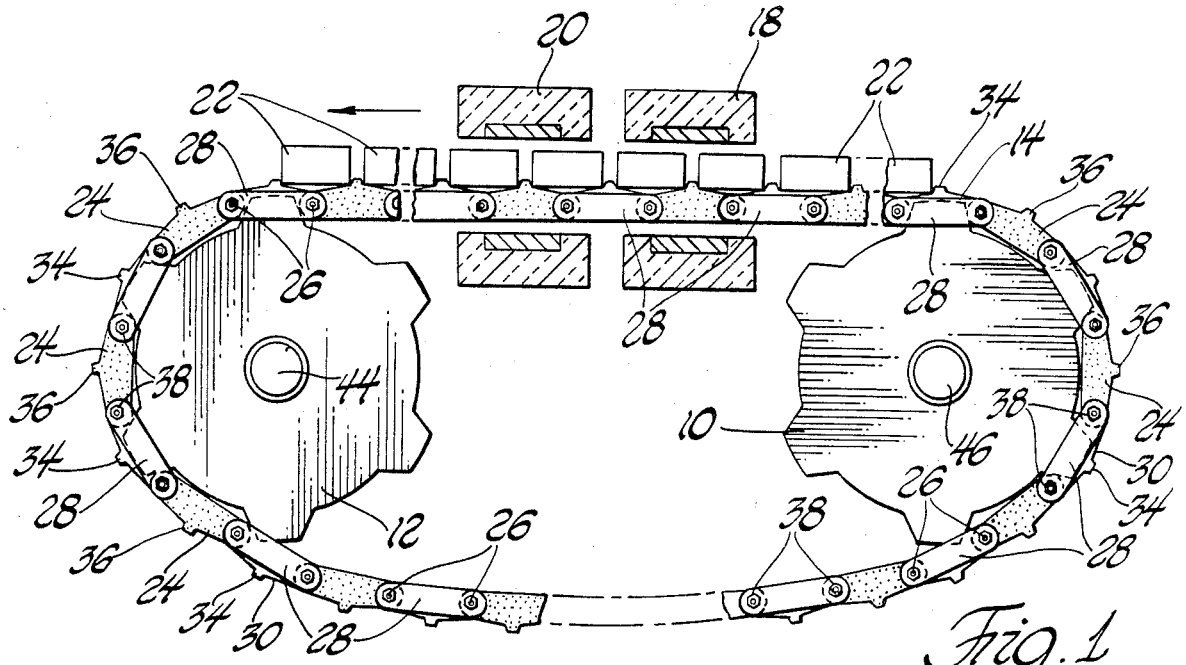
FIG. 1 is a diagrammatic representation of the feed chain and induction heating apparatus in elevational view.

Referring to the drawings, wherein like characters represent the same or corresponding parts throughout the several views, there is seen in FIG. 1 a pair of cogwheels 10 and 12. These cogwheels 10 and 12 mesh with a pair of feed chains 14 and 16. The cogwheel 12 is the driving cog while cogwheel 10 is the driven cogwheel. This maintains the feed chains 14 and 16 taut between the upper surfaces of the cogwheels 10 and 12 while passing through induction heating coils 18 and 20. Spanning the laterally spaced feed chains 14 and 16 are a plurality of steel bars 22 which are substantially rectangular in cross section in both the longitudinal and lateral directions. If desired, the feed chains 14 and 16 can ride on silicon nitrite pads when spanning the length between the cogwheels 10 and 12 thereby maintaining or assisting the support of the feed chains.

Figure 2:
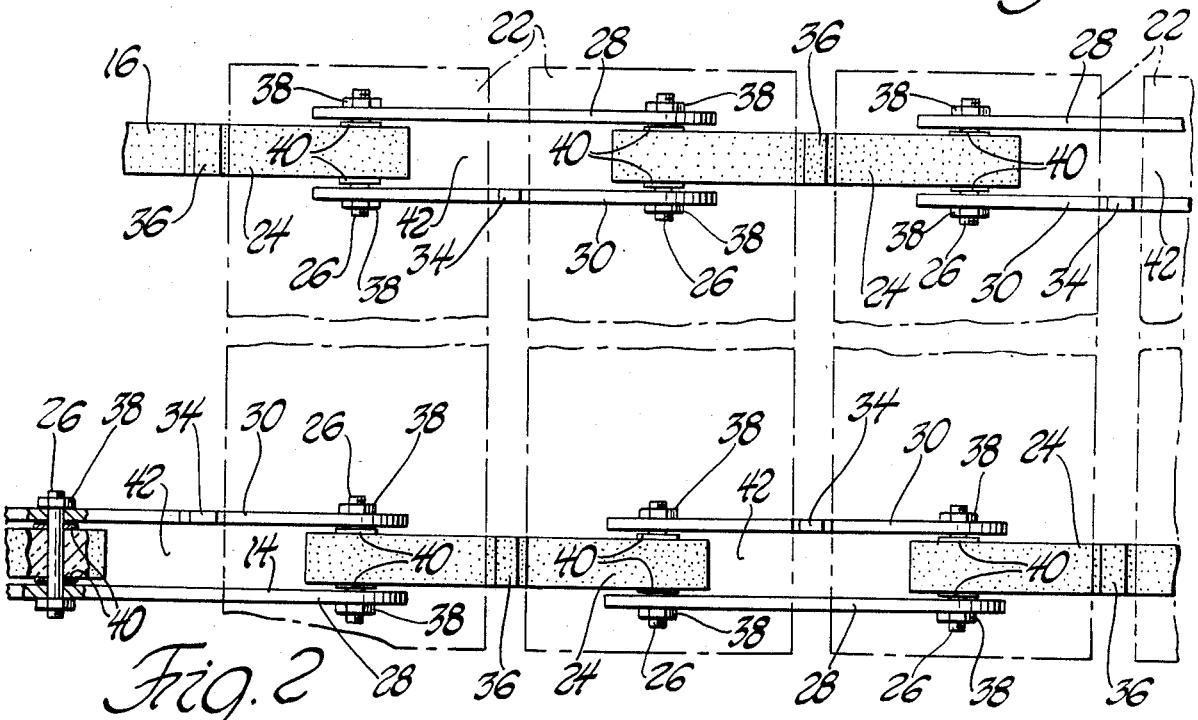
FIG. 2 is a top view of the feed chain mechanism.
Figure 3:
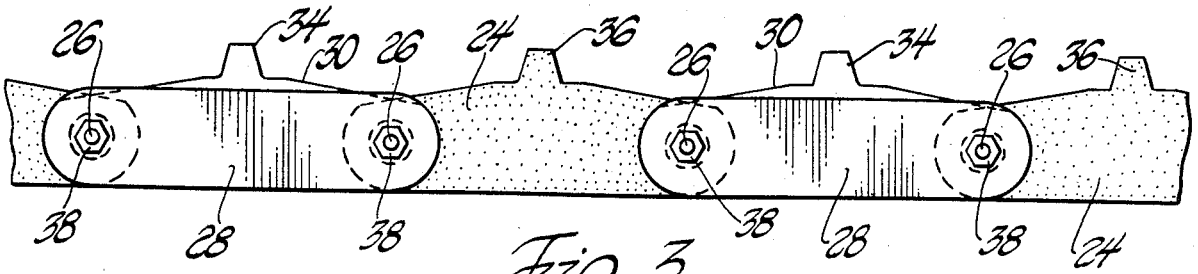
FIG. 3 is a side elevation view of the feed chain.

As best seen in FIG. 2, each feed chain has a plurality of ceramic links 24 pivotally connected by threaded pins 26 to a pair of stainless steel links 28 and 30. The stainless steel links 30 are disposed at the laterally inner edge of the feed chains 14 and 16, as shown, and have formed thereon a drive lug 34 which is operable to contact the steel bars 22 to prevent movement longitudinally thereof on the feed chain. Each ceramic link 24 also has a drive lug 36 which accomplishes the same purpose as drive lug 34 and cooperates therewith to maintain the desired longitudinal spacing of the steel bars 22. The ceramic links 24 are preferably made from hot-pressed silicon nitrite and the threaded pins 26 are formed from stainless steel. The pins 26 are maintained in position by a plurality of fasteners or nuts 38. A brass washer 40 is disposed between each stainless steel link 30 and 28 and the ceramic links 24. This structure has been found to provide a very durable and workable flexible joint connection for the feed chain.

As seen in FIGS. 1 and 2, the bars 22 do not come into contact with any of the bars adjacent thereto. It should also be noted that the stainless steel link pairs are disposed laterally opposite the ceramic link so that adjacent metal bars 22 do not have metal-to-metal contact at both ends which would permit the creation of a secondary induction loop. Therefore, arcing between the adjacent bars is prevented.

The stainless steel link pairs 28 and 30 have formed therebetween a space 42 in which the cogs of cogwheels 10 and 12 mesh during the driving of the feed chains 14 and 16. The cogwheels 10 and 12 maintain the lateral spacing of the ceramic and stainless steel links such that the above-mentioned induction loop between adjacent metal bars is effectively prevented.

It will be appreciated that while only one cogwheel 10 and one cogwheel 12 is shown, there will be one provided for each feed chain 14 and 16. Cogwheels 12 will be secured to a common shaft 44 while cogwheels 10 will be secured to a common shaft 46.

The induction coils 18 and 20 can be controlled by a conventional electrical circuit which, if desired, can respond to a conventional control switch, not shown, activated by the metal bars 22 prior to entering the induction coils 18 and 20 such that the furnace will be at the desired heat-treating temperature as the first steel bar 22 enters the furnace. Should it become desirable or necessary to shut down the furnace, the induction coils can be controlled, through a conventional timer apparatus to remain at the desired temperature for a predetermined period of time after the control switch has been released thereby ensuring that all of the steel bars that pass through the induction coils will be properly heat-treated.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. A feed chain mechanism for use in a device for continuously feeding metal bars through an induction furnace, said chain mechanism comprising a pair of laterally spaced feed chains, each chain including a plurality of links, alternate links on each chain being stainless steel and ceramic, said stainless steel links being disposed in pairs inboard and outboard of said adjacent ceramic links to form a drive slot between the stainless steel link pairs; pin means joining said adjacent stainless steel links and said ceramic links to form a continuous feed chain, said stainless steel links on one of said feed chains being disposed laterally opposite the ceramic links on the other of said feed chains to prevent the creation of a continuous loop for conducting electrical current in adjacent metal bars laterally spanning the chains and also providing spacing between adjacent metal bars as the metal bars pass through an induction furnace to prevent arcing therebetween; and cog means meshing with said drive slot on said feed chain for maintaining the lateral disposition of said links during the operation of said feed chain mechanism.

2. A feed chain mechanism for use in a device for continuously feeding metal bars through an induction furnace, said chain mechanism comprising a pair of laterally spaced feed chains, each chain including a plurality of links, alternate links on each chain being stainless steel and ceramic, said stainless steel links being disposed in pairs inboard and outboard of said adjacent ceramic links to form a drive slot between the stainless steel link pairs; pin means joining said adjacent stainless steel links and said ceramic links to form a continuous feed chain, said stainless steel links on one of said feed chains being disposed laterally opposite the ceramic links on the other of said feed chains to prevent the creation of a continuous loop for conducting electrical current in adjacent metal bars laterally spanning the chains: each ceramic link and inboard stainless steel link having drive lug means disposed thereon for maintaining longitudinal spacing between the adjacent metal bars passing through an induction furnace to prevent arcing therebetween; and cog means meshing with said drive slot on said feed chain for maintaining the lateral disposition of said links during the operation of said feed chain mechanism.

3. A feed chain mechanism for use in a device for continuously feeding metal bars through an induction furnace and maintaining longitudinal spacing between adjacent metal bars, said chain mechanism comprising a pair of laterally spaced feed chains, each chain including a plurality of links, alternate links on each chain being stainless steel and ceramic, said stainless steel links being disposed in pairs inboard and outboard of said adjacent ceramic links to form a drive slot between the stainless steel link pairs; pin means joining said adjacent stainless steel links and said ceramic links to form a continuous feed chain, said stainless steel links on one of said feed chains being disposed laterally opposite the ceramic links on the other of said feed chains to prevent the creation of a continuous loop for conducting electrical current in adjacent metal bars laterally spanning the chains; drive means disposed on said pair of stainless steel links and said ceramic links for maintaining the longitudinal spacing of said metal bars to prevent arcing therebetween and for providing a drive surface to assist in maintaining movement of said metal bars through an induction furnace; and cog means meshing with said drive slot on said feed chain for maintaining the lateral disposition of said links during the operation of said feed chain mechanism.

* * * * *